US009284495B2

(12) United States Patent
Upson et al.

(10) Patent No.: US 9,284,495 B2
(45) Date of Patent: Mar. 15, 2016

(54) MAINTAINING CATALYST ACTIVITY FOR CONVERTING A HYDROCARBON FEED

(75) Inventors: Lawrence L. Upson, Barrington, IL (US); Brian W. Hedrick, Oregon, IL (US); Keith Allen Couch, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 947 days.

(21) Appl. No.: 12/408,046

(22) Filed: Mar. 20, 2009

(65) Prior Publication Data

US 2010/0236980 A1 Sep. 23, 2010

(51) Int. Cl.

| | |
|---|---|
| ***C10G 51/04*** | (2006.01) |
| ***B01J 8/26*** | (2006.01) |
| ***C10G 51/02*** | (2006.01) |
| ***C10G 11/05*** | (2006.01) |
| ***C10G 51/06*** | (2006.01) |

(52) U.S. Cl.

CPC ..... *C10G 51/026* (2013.01); *C10G 11/05* (2013.01); *C10G 51/06* (2013.01)

(58) Field of Classification Search

CPC ..... C10G 11/18; C10G 11/00; C10G 11/10; C10G 51/026; B01J 8/26; B01J 8/28; B01J 8/36; F23C 10/005

USPC ..... 585/648, 653, 638–640, 660, 662; 208/106, 113, 118, 119, 120.01, 78, 208/80, 49, 67, 72, 73, 74, 70, 120.1; 422/142; 502/64, 66, 67, 68, 52

See application file for complete search history.

(56) References Cited

U.S. PATENT DOCUMENTS

| | | | | |
|---|---|---|---|---|
| 3,470,084 | A | | 9/1969 | Scott |
| 3,856,659 | A | * | 12/1974 | Owen ..... 208/80 |
| 4,090,948 | A | | 5/1978 | Schwarzenbek |
| 4,309,279 | A | * | 1/1982 | Chester et al. ..... 208/120.05 |
| 4,606,810 | A | * | 8/1986 | Krambeck et al. ..... 208/74 |
| 4,717,466 | A | | 1/1988 | Herbst et al. |
| 4,814,068 | A | | 3/1989 | Herbst et al. |
| 4,827,069 | A | | 5/1989 | Kushnerick et al. |
| 4,861,741 | A | | 8/1989 | Herbst et al. |
| 4,865,718 | A | | 9/1989 | Herbst et al. |
| 4,871,446 | A | | 10/1989 | Herbst et al. |
| 4,927,522 | A | | 5/1990 | Herbst et al. |
| 4,927,523 | A | * | 5/1990 | Donnelly ..... 208/120.01 |
| 4,927,526 | A | * | 5/1990 | Anderson et al. ..... 208/152 |
| 5,154,818 | A | | 10/1992 | Harandi et al. |
| 5,451,313 | A | | 9/1995 | Wegerer et al. |

(Continued)

FOREIGN PATENT DOCUMENTS

EP 0 381 870 A1 8/1990

OTHER PUBLICATIONS

Irion, et al., "Oil Refining" in Ullmann's Encyclopedia of Industrial Chemistry, 2007, John Wiley, available on-line Jan. 15, 2007.*

(Continued)

*Primary Examiner* — In Suk Bullock
*Assistant Examiner* — Aaron Pierpont
(74) *Attorney, Agent, or Firm* — James C. Paschall

(57) ABSTRACT

One exemplary embodiment can be a process for fluid catalytic cracking. The process can include withdrawing a catalyst from a reaction vessel to replace a catalyst inventory over a period of about 10- about 35 days for maximizing propylene yield.

11 Claims, 2 Drawing Sheets

(56) References Cited

U.S. PATENT DOCUMENTS

| | | | | |
|---|---|---|---|---|
| 5,985,133 | A * | 11/1999 | Moore | 208/113 |
| 6,106,697 | A * | 8/2000 | Swan et al. | 208/77 |
| 6,222,087 | B1 * | 4/2001 | Johnson et al. | 585/651 |
| 7,247,233 | B1 | 7/2007 | Hedrick et al. | |
| 7,261,807 | B2 | 8/2007 | Henry et al. | |
| 7,312,370 | B2 | 12/2007 | Pittman et al. | |
| 7,323,099 | B2 * | 1/2008 | Henry | 208/67 |
| 2005/0096492 | A1 * | 5/2005 | Dath et al. | 585/653 |
| 2007/0020154 | A1 * | 1/2007 | Evans | 422/139 |
| 2008/0035527 | A1 * | 2/2008 | Eng et al. | 208/113 |
| 2008/0093263 | A1 * | 4/2008 | Cheng et al. | 208/114 |
| 2008/0188702 | A1 * | 8/2008 | Hadjigeorge et al. | 585/653 |

OTHER PUBLICATIONS

Barker, et al., "Petroleum" in Kirk-Othmer Encyclopedia of Chemical Technology, John Wiley & Sons, May 2005, pp. 1, 7-10, 23-30, and 39.*

Hemler, et al., "Maximising FCC Propylene Production" in Petroleum Technology Quarterly, 4(2), pp. 31-35, 1999—month unknown.*

Hemler, C.L.; Upson, L.L. "Maximising FCC Propylene Production" in Petroleum Technology Quaterly, 4(2), pp. 31-35, 1999.*

Barker, C.; Robbins, W.K.; Hsu, C.S.; Drew, L.J.; "Petroleum" in Kirk-Othmer Encyclopedia of Chemical Technology, John Wiley & Sons, 2005.*

Definition of "attrition".*

Lu et al., Exploratory Study on Upgrading 1-Butene Using Spent FCC Catalyst/Additive Under Simulated Conditions of FCCU's Stripper, Applied Catalysis, A: General, vol. 255(2), 2003, pp. 345-347.

Zhenyu et al., Study on Deactivation and Cracking Performance of Catalysts Containing Y and MFI Zeolites, China Petroleum Processing and Petrochemical Technology, No. 1, Mar. 2004, pp. 29-35.

U.S. Appl. No. 12/344,598, filed Dec. 29, 2008 entitled, "Fluid Catalytic Cracking System and Process" to Mehlberg et al.

* cited by examiner

MAINTAINING CATALYST ACTIVITY FOR CONVERTING A HYDROCARBON FEED

FIELD OF THE INVENTION

This invention generally relates to fluid catalytic cracking, and more preferably maintaining catalyst activity in such a system and/or process.

DESCRIPTION OF THE RELATED ART

Catalytic cracking can create a variety of products from larger hydrocarbons. Often, a feed of a heavier hydrocarbon, such as a vacuum gas oil, is provided to a catalytic cracking reactor, such as a fluid catalytic cracking reactor. Various products may be produced from such a system, including a gasoline product and/or light product such as propylene and/or ethylene.

In such systems, a single reactor or a dual reactor can be utilized. Although additional capital costs may be incurred by using a dual reactor system, one of the reactors can be operated to tailor conditions for maximizing products, such as light olefins including propylene and/or ethylene.

It can be desirable to provide fresh catalyst to maintain product yields. Typically, fresh catalyst replaces lost catalyst, which can amount to about 1%, by weight, of the total catalyst in the unit per day.

Also, it can often be advantageous to maximize yield of a product in one of the reactors. Moreover, some dual reactor systems utilize a mixture of catalysts, such as a larger pore catalyst and a smaller pore catalyst. In some instances, the mixture can be subject to regeneration. In such systems, the regeneration may have an adverse affect on catalyst performance. Particularly, some catalyst can require little or no regeneration. Hence, the common regeneration of the mixture may result in unnecessarily regenerating and possibly deactivating one of the catalysts of the mixture. Consequently, it typically would be beneficial to maintain at least one catalyst in a relatively fresh state to increase yields.

SUMMARY OF THE INVENTION

One exemplary embodiment can be a process for fluid catalytic cracking. The process can include withdrawing a catalyst from a reaction vessel to replace a catalyst inventory over a period of about 10- about 35 days for maximizing propylene yield.

Another exemplary embodiment can be a process for maintaining the activity of a catalyst for converting a hydrocarbon feed into one or more products including propylene. Generally, the process includes withdrawing the catalyst from a second reaction zone of a fluid catalytic cracking unit. Usually, the unit includes at least two reaction zones. The second reaction zone may include a second reaction vessel having a second volume, and a catalyst inventory is withdrawn over a period of about 10- about 35 days for maximizing propylene yield.

A further exemplary embodiment may be a fluid catalytic cracking system. The fluid catalytic cracking system can include a reaction zone containing an MFI catalyst that may have an initial average diameter of at least about 20 microns and has a rate of attrition greater than another catalyst in the system.

Thus, the embodiments disclosed herein can provide a dual reactor system that can maximize the production of a desired product, such as a light olefin, e.g., propylene. The embodiments disclosed herein can control conversion conditions by providing a fresh amount of a catalyst to convert a feed. Particularly, one suitable catalyst that can be maintained at a high activity is ZSM-5. By providing a catalyst to maintain activity at a higher level, the increased conversion of a hydrocarbon feed can be obtained. A hydrocarbon feed can be a typical feed such as a vacuum gas oil or similar type product, or can be an olefinic recycle stream of one or more C4-C10 olefins. The catalyst can be maintained at a higher activity by increasing catalyst withdrawals with corresponding catalyst additions, or providing a catalyst particle with a higher attrition rate. In the latter example, providing a catalyst with a higher attrition rate can allow the catalyst to break down into smaller particles that can be removed in a regenerator flue gas as well as a product from the system. As a consequence, catalyst can be added back to the system to make up for attrition losses. Thus, the overall activity of the catalyst can be maintained at a relatively high level to increase conversions. Hence, the embodiments disclosed herein can provide a mechanism for maximizing a desired product yield, particularly of a light olefin.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of generally at least about 50%, and preferably about 70%, by mole, of a compound or class of compounds in a stream.

As used herein, the term "substantially" can mean an amount of generally at least about 80%, preferably about 90%, and optimally about 99%, by mole, of a compound or class of compounds in a stream.

As used herein, the term "fixed bed" generally means a catalyst that remains substantially stationary in a reactor.

As used herein, the term "fluidized bed" generally means that catalytic solids are suspended within the bed.

As used herein, the term "riser reactor" generally means a reactor used in a fluid catalytic cracking process that can include a riser, a reaction vessel, and a stripper. Usually, such a reactor may include providing catalyst at the bottom of a riser that proceeds to a reaction vessel having a mechanism for separating the catalyst from a hydrocarbon.

As used herein, the term "catalyst inventory" generally means at least about 90%, preferably about 95%, by weight, of catalyst in a catalyst section, which can include a reaction zone and a regeneration zone.

DETAILED DESCRIPTION

Figure 1:
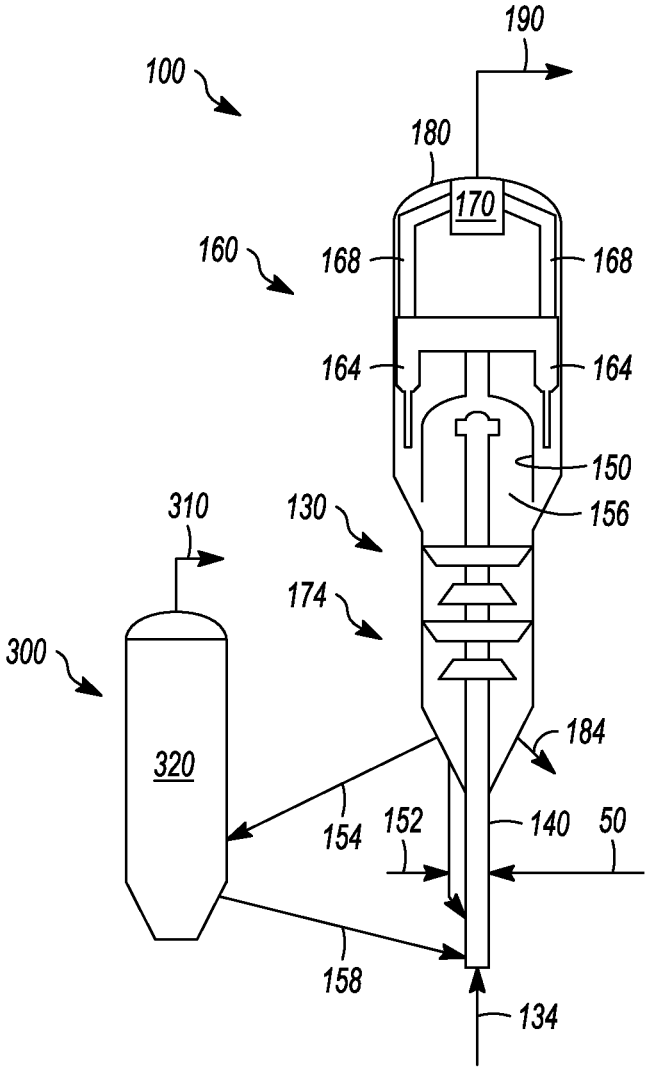
FIG. 1 is a schematic depiction of an exemplary system and/or unit.

Referring to FIG. 1, an exemplary fluid catalytic cracking system and/or unit 100 can usually include a reaction zone or a first reaction zone 130 and a regeneration zone 300. In this exemplary embodiment, a catalyst section can include the first reaction zone 130 and a regeneration zone 300. Generally, the first reaction zone 130 can include a first riser 140 terminating in a first reaction vessel 150 defining a volume 156. Although a riser reactor is depicted, it should be understood that any suitable reactor or reaction vessel can be utilized, such as a fluidized bed reactor or a fixed bed reactor. The first riser 140 can receive a feed 50 that can have a boiling point range of about 180- about 800° C. Typically, the feed 50 can be at least one of a gas oil, a vacuum gas oil, an atmospheric gas oil, and an atmospheric residue. Alternatively, the feed 50 can be at least one of a heavy cycle oil and a slurry oil. Generally, the feed 50 can be a fresh feed, or receive a recycle stream from, for example, a product separation zone having one or more distillation columns. It should be noted that process flow lines in the figures can be referred to interchangeably as, e.g., lines, feeds, mixtures or streams. Particularly, a line can contain one or more feeds, mixtures, or streams, and one or more feeds, mixtures, or streams can be contained by a line.

Generally, the feed 50 can be provided at any suitable height on the first riser 140, such as above a line 134 providing a lift gas, such as steam and/or a light hydrocarbon, to the first riser 140. The feed 50 may be provided at a distance sufficient to provide a good dispersion of the up-flowing feed and/or catalyst, if desired. Although not depicted, a mixing chamber can also be provided at the bottom of the first riser 140 to mix, e.g., a mixture of spent and regenerated catalyst. An exemplary mixing chamber is disclosed in, e.g., U.S. Pat. No. 5,451,313.

The catalyst can be a single catalyst or a mixture of different catalysts. Usually, the catalyst includes two components or catalysts, namely a first component or catalyst, and a second component or catalyst. Such a catalyst mixture is disclosed in, e.g., U.S. Pat. No. 7,312,370 B2.

Generally, the first catalyst may include any of the catalysts that are used in the art of fluid catalytic cracking (hereinafter may be abbreviated "FCC"), such as an active amorphous clay-type catalyst and/or a high activity, crystalline molecular sieve. Zeolites may be used as molecular sieves in FCC processes. Preferably, the first catalyst includes a large pore zeolite, such as a Y-type zeolite, an active alumina material, a binder material, including either silica or alumina, and an inert filler such as kaolin.

Typically, the zeolitic molecular sieves appropriate for the first catalyst have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first catalyst, such as the zeolite, can have any suitable amount of a rare earth metal or rare earth metal oxide.

The second catalyst may include a medium or smaller pore zeolite catalyst, such as a MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second catalyst has the medium or smaller pore zeolite dispersed on a matrix including a binder material such as silica or alumina and an inert filler material such as kaolin. The second catalyst may also include some other active material such as Beta zeolite. These compositions may have a crystalline zeolite content of about 10- about 50 weight percent (hereinafter may be abbreviated as "wt. %") or more, and a matrix material content of about 50- about 90 wt. %. Components containing about 40 wt. % crystalline zeolite material are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31.

The total mixture in the first reaction zone 130 may contain about 1- about 25 wt. % of the second catalyst, namely a medium to small pore crystalline zeolite with greater than or equal to about 1.75 wt. % of the second catalyst being preferred. The first catalyst may comprise the balance of the catalyst composition. In some preferred embodiments, the relative proportions of the first and second catalysts in the mixture may not substantially vary throughout the system 100. The high concentration of the medium or smaller pore zeolite as the second catalyst of the catalyst mixture can improve selectivity to light olefins. In one exemplary embodiment, the second catalyst can be a ZSM-5 zeolite and the mixture can include about 4- about 10 wt. % ZSM-5 zeolite excluding any other components, such as binder and/or filler.

Preferably, at least one of the first and/or second catalysts is an MFI zeolite having any suitable ratio of silicon to aluminum, such as a silicon to aluminum ratio greater than about 15. In one exemplary embodiment, the silicon to aluminum ratio can be about 15:1- about 35:1.

Generally, the first feed 50 and the catalyst mixture can be provided proximate to the bottom of the first riser 140. Typically, the first riser 140 operates with dilute phase conditions above the point of feed injection with a density that is less than about 320 kg/m$^3$. Usually, the first feed 50 is introduced into the first riser 140 by a nozzle. Usually, the first feed 50 has a temperature of about 140- about 320° C. Moreover, additional amounts of feed may also be introduced downstream of the initial feed point.

In addition, the first reaction zone 130 can be operated at low hydrocarbon partial pressure in one desired embodiment. Generally, a low hydrocarbon partial pressure can facilitate the production of light olefins. Accordingly, the first riser 140 pressure can be about 170- about 250 kPa with a hydrocarbon partial pressure of about 35- about 180 kPa, preferably about 70- about 140 kPa. A relatively low partial pressure for hydrocarbon may be achieved by using steam as a diluent, in the amount of about 10- about 55 wt. %, preferably about 15 wt. % of the feed. Other diluents, such as dry gas, can be used to reach equivalent hydrocarbon partial pressures.

The one or more hydrocarbons and catalyst rise to the reaction vessel 150 converting the first feed 50. Usually, the feed 50 reacts within the first riser 140 to form one or more products. The first riser 140 can operate at any suitable temperature, and typically operates at a temperature of about 150- about 580° C., preferably about 520- about 580° C. In one exemplary embodiment, a higher riser temperature may be desired, such as no less than about 565° C. Exemplary risers are disclosed in, e.g., U.S. Pat. Nos. 5,154,818 and 4,090,948.

The products can rise within the first riser 140 and exit within the first reaction vessel 150. Typically, products including propylene and gasoline are produced. Subsequently, the catalyst can separate assisted by any suitable device, such as swirl arms, and settle to the bottom of the first reaction vessel 150. In addition, a first mixture including one or more products and any remaining entrained catalyst can rise into a catalyst disengagement zone 160. In the catalyst disengagement zone 160, any remaining entrained catalysts can be separated. Generally, the first reaction zone 130 can include a shell 180 containing at least a portion of the reaction vessel 150, the catalyst disengagement zone 160, optionally at least a portion of a stripping zone 174. Although the first reaction vessel 150 is described as being a reaction vessel, it should be understood that other processes can occur such as the separation of catalyst from the hydrocarbons exiting the first riser 140. As such, reactions may primarily occur in the first riser 140 that can be at least partially contained by and incorporated in the first reaction vessel 150. Moreover, the first reaction vessel 150 can include the stripping zone 174. Particularly, although catalyst can be separated from the hydrocarbons, some reactions may still occur within the first reaction vessel 150. Usually, the catalyst disengagement zone 160 can include separation devices, such as one or more cyclone separators 164 for separating out the products from the catalyst particles. Dip legs may drop the catalyst down to the base of the shell 180 where openings can permit entry of the spent catalyst into the first reaction vessel 150 to a dense catalyst bed. Exemplary separation devices and swirl arms are disclosed in, e.g., U.S. Pat. No. 7,312,370 B2. The catalyst may pass through the stripping zone 174 where absorbed hydrocarbons can be removed from the surface of this catalyst by counter-current contact with steam. An exemplary stripping zone is disclosed in, e.g., U.S. Pat. No. 7,312,370 B2. Afterwards, the catalyst can be regenerated by passing through a line 154 to the regeneration zone 300. The regeneration zone 300 can include a regeneration vessel 320. Exemplary regeneration vessels are disclosed in, e.g., U.S. Pat. Nos. 7,312,370 B2 and 7,247,233 B1. The regenerated catalyst can return to the riser 140 via a line 158.

The one or more products leaving the disengagement zone 160 can exit through a plurality of lines 168 before entering a plenum 170 of the shell 180. Afterwards, a product 190 can pass from the shell 180 for further processing as, e.g., a product separation zone having one or more distillation columns. Such zones are disclosed in, e.g., U.S. Pat. No. 3,470,084. Usually, the product separation zone may produce several products, such as a propylene product and a gasoline product.

In one exemplary embodiment, a second catalyst, such as the ZSM-5 catalyst, can be withdrawn through a line 184 at an accelerated rate at steady-state conditions to maintain its activity within the reaction vessel 150. Particularly, the catalyst ZSM-5 along with the Y-zeolite can be withdrawn to require additional catalyst provided via a line 152 to replace the volume 156 within no more than about 25 days. This relatively high turnover can maintain relatively fresh catalyst, particularly ZSM-5, within the reaction vessel 150. In contrast, the combined catalyst can have a life of about 100 or more days with a correspondingly significantly lower ZSM-5 activity without an accelerated withdraw. The withdrawn mixture can be stored and optionally reused in other fluid catalytic cracking units.

In an alternative embodiment, the second catalyst can be made to attrit to a desired size. Particularly, the catalyst can attrit to a size to less than about 2 microns. Particularly, a second catalyst, such as an MFI catalyst, may have an initial diameter of at least 20 microns. Particularly, the binder or amorphous material used to give the catalyst strength and attrition resistance can be modified to optimize the end use of the catalyst. Particularly, the binder may be inert, such as alumina or some other material compatible with the catalytic zeolite, such as ZSM-5. In addition, catalyst particles made from different physical properties with less attrition resistance can allow the catalyst to be separated. The attrited catalyst particles can pass in the flue gas stream in a line 310 from the regeneration zone 300, as well as particles can pass in the product 190. Generally, the catalyst is added and withdrawn or attrited at a rate effective to convert the hydrocarbon feed 50 to provide a propylene yield of at least about 12%, by weight.

Figure 2:
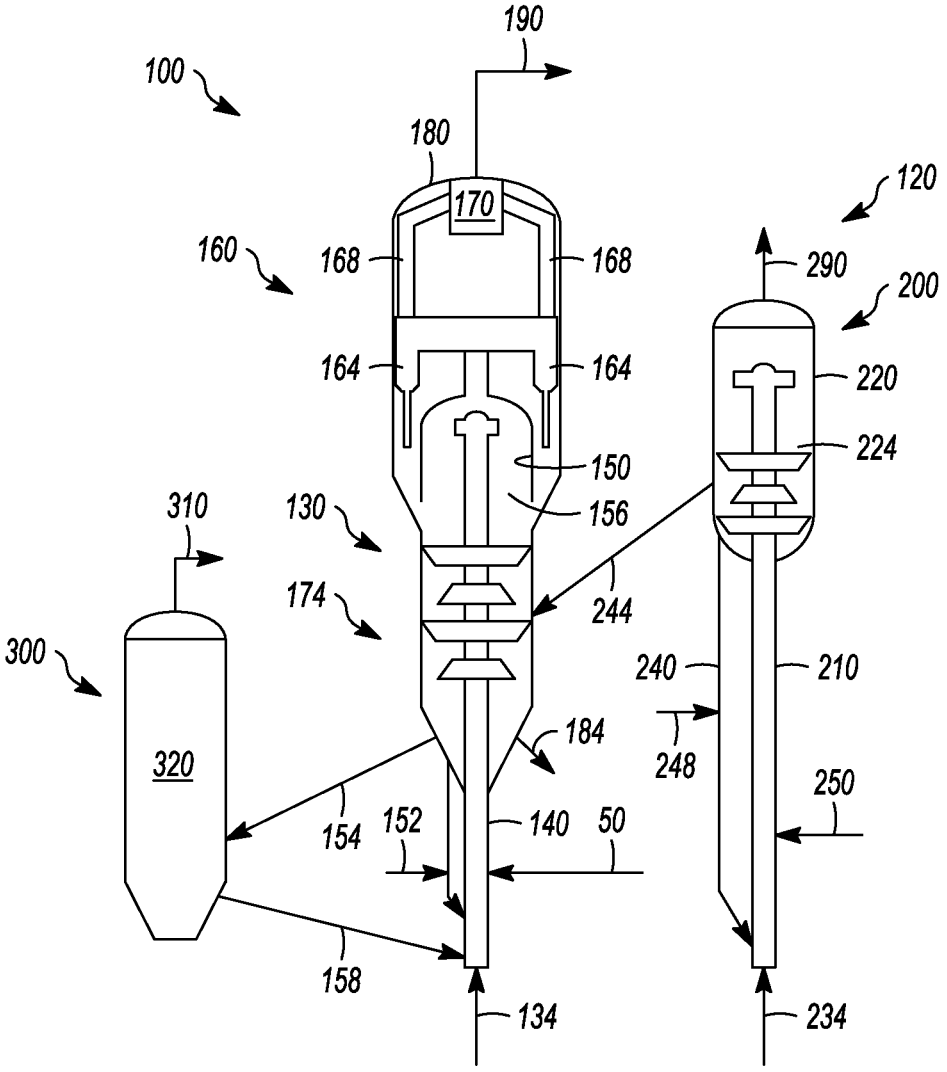
FIG. 2 is a schematic depiction of another exemplary system and/or unit.

Referring to FIG. 2, another exemplary fluid catalytic cracking system and/or unit 100 can usually include at least two reaction zones 120, such as the first reaction zone 130 and a second reaction zone 200, and the regeneration zone 300. Although not depicted, the second reaction zone 200 can also include a regeneration zone. In this exemplary embodiment, the catalyst section can include the second reaction zone 200 and the regeneration zone 300. The first reaction zone 130 and the regeneration zone 300 have been described above. Moreover, a single catalyst or a mixture of catalyst can be used as described above as well.

The second reaction zone 200 can receive a feed 250, which can be the same or different as the feed 50. In one preferred embodiment the feed 250 may be one or more C4-C10 olefins. Typically, the feed 250 can be provided above a line 234 providing a lift gas, such as steam and/or a light hydrocarbon, to the second riser 210. Optionally, the steam may be provided in the amount of about 5- about 40%, by weight, with respect to the weight of the feed 250. The feed 250 can include at least about 50%, by mole, of the components in a gas phase. Preferably, the entire feed 250, i.e., at least about 99%, by mole is in a gas phase. Generally, the temperature of the feed 250 can be about 120- about 600° C. when entering the second riser 210. Usually, the temperature of the feed 250 should at least be above the boiling point of the components. Otherwise, the feed 250 can be provided directly to the second riser 210 with the catalyst recirculated from a second reaction vessel 220.

The second reaction zone 200 can include a second riser 210 terminating in a second reaction vessel 220. Catalyst may be recycled via a line 240 from the second reaction vessel 220. Fresh catalyst can be provided via a line 248. The second reaction zone 200 can be operated at a temperature greater than the first reaction zone 130, preferably a temperature of about 560- about 620° C. Usually, a chamber can be provided at the base of the second riser 210 that may receive catalyst. Such a mixing chamber is disclosed in, e.g., U.S. Pat. No. 5,451,313. Although the second reaction zone 200 is depicted as including a riser reactor, it should be understood that any suitable reactor can be utilized, such as a fixed bed or a fluidized bed.

Generally, the second reaction vessel 220 can contain the second catalyst, preferably a ZSM-5 zeolite, and optionally a first catalyst, preferably a Y-zeolite. Typically, it is desirable for the second reaction vessel 220 to contain only unregenerated catalyst to maintain the catalyst life, which can be provided via a line 248. Particularly, the second catalyst component, e.g., ZSM-5, generally tends to not have great accumulation of coke, and therefore, may not need to be regenerated. As such, typically the second reaction vessel 220 can contain an unregenerated catalyst. Alternatively, a regenerated catalyst may also be provided via the line 248.

Usually, the second reaction vessel defines a volume 224. In one exemplary embodiment, the ZSM-5 catalyst can be withdrawn via the line 244 at an accelerated rate to maintain its activity within the second reaction vessel 220. Particularly, the catalyst ZSM-5 can be withdrawn at rate to replace a catalyst inventory in up to about 35 days. This relatively high turnover can maintain relatively fresh catalyst within the second reaction vessel 220. In addition, the withdrawn catalyst through a line 244 can be put into the stripping zone 174.

The second riser 210 can operate in any suitable conditions, such as a temperature of about 425- about 705° C, preferably a temperature of about 560- about 620° C., and a pressure of about 40- about 700 kPa, preferably a pressure of about 40- about 400 kPa, and optimally a pressure of about 200- about 250 kPa. Typically, the residence time of the second riser 210 can be less than about 3 seconds, preferably less than about 1 second, and optimally less than about 0.5 second. Exemplary risers and/or operating conditions are disclosed in, e.g., US 2008/0035527 A1 and U.S. Pat. No. 7,261,807 B2.

Generally, the feed 250 and the catalyst can rise to the second reaction vessel 220 and the catalyst and the hydrocarbon products can separate. The catalyst can drop to a dense catalyst bed within the second reaction vessel 220 and optionally be provided to the base of the second riser 210. Alternatively, spent catalyst can be periodically withdrawn from the second reaction zone 200 via the line 244 to the first reaction zone 130 and replaced by fresh catalyst to maintain activity in the second reaction zone 200. Generally, the second reaction zone 200 may operate under conditions to convert the feed 250 into one or more light olefins, such as ethylene and/or propylene, preferably propylene. Afterwards, the hydrocarbon products can separate and exit the second reaction zone 200 through the line 290.

The second catalyst can be provided directly to the second reaction vessel 220 and periodically be dispensed through a line 244 to the stripping zone 174. The second catalyst may not require as high of activity in the first reaction zone 130 as the second reaction zone 200 to produce the desired olefins. The dispensed catalyst can combine with the first mixture and provide additional catalyst activity to the combination. The catalyst utilized in the first reaction zone 130 and the second reaction zone 200 can be separated from the hydrocarbons. As such, the catalysts can settle into the stripping zone 174 and be subjected to stripping the stream and subsequent regeneration, as discussed above.

With the at least two reaction zones 120, several possibilities can maintain a fresh second catalyst, such as ZSM-5, to increase propylene production. In these examples, typically the first reaction vessel 150 may contain a blend of Y-zeolite and ZSM-5, and the second reaction vessel 220 can contain ZSM-5 and optionally Y-zeolite. As example, if the ZSM-5 catalyst inventory is removed and replaced in about 15 days, catalyst in the second reaction vessel 220 may include about 50%, by weight, of fresh ZSM-5 and about 50%, by weight, of regenerated catalyst from the regeneration zone 300. The catalyst from the second reaction vessel 220 can continuously be transferred to the first reaction vessel 150. The first reaction vessel 150 may contain a blend of up to about 20%, by weight, ZSM-5 with no fresh ZSM-5 added to the first reactor vessel 150.

Another example can remove and replace the catalyst inventory of the second catalyst, e.g., ZSM-5, in about 25 days. The second reaction vessel 220 may contain about 100%, by weight, unregenerated ZSM-5 additive. Spent ZSM-5 catalyst from the second reaction vessel 220 can be provided to the first reaction vessel 150 to obtain 20%, by weight, ZSM-5 catalyst in the ZSM-5/Y-zeolite mixture in the first reaction vessel 150. Typically, no additional ZSM-5 catalyst would be added to the first reaction vessel 150.

In yet another example, if the catalyst inventory of the second catalyst is removed and replaced in more than about 25 days, such as about 35 days, then the second reaction vessel 220 can contain 100%, by weight, unregenerated, e.g., ZSM-5. The spent ZSM-5 catalyst from the second reaction vessel 220 can be continuously provided to the first reaction vessel 150. If desired, additional fresh ZSM-5 catalyst can be provided to the first reaction vessel 150 via the line 152.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for fluid catalytic cracking, comprising:

contacting a hydrocarbon feed with a catalyst mixture in a reaction vessel wherein the catalyst mixture comprises 99-75% by weight of a large pore zeolite and 1-25% by weight of a medium or smaller pore zeolite having an initial average particle diameter of at least about 20 microns;

withdrawing the medium or smaller pore zeolite from the reaction vessel and providing fresh catalyst to the reaction vessel at a rate to replace a catalyst inventory of the medium or smaller pore zeolite over a period of up to about 35 days, wherein the fresh catalyst comprises fresh medium or smaller pore zeolite, fresh large pore zeolite, or both;

providing feed to a riser in the reaction vessel and obtaining a propylene yield of at least about 12% by weight;

wherein the medium or smaller pore zeolite has a higher attrition rate than the large pore zeolite; and wherein the medium or smaller pore zeolite is attrited to a size less than 2 microns.

2. The process according to claim 1, further comprising a second reaction vessel containing a second catalyst.

3. The process according to claim 2, wherein the second catalyst comprises the medium or smaller pore zeolite and optionally the large pore zeolite, and the reaction vessel contains the catalyst mixture.

4. The process according to claim 3, wherein the medium or smaller pore zeolite of the second catalyst comprises an MFI catalyst.

5. The process according to claim 1, wherein the rate to replace the catalyst inventory is over a period of about 10 to about 35 days.

6. The process according to claim 3, wherein the fresh catalyst is provided to the riser.

7. The process according to claim 3, wherein the medium or smaller pore zeolite of the second catalyst is at least about 50%, by weight, fresh ZSM-5.

8. The process of claim 1, wherein the hydrocarbon feed comprises one or more C4-C10 olefins.

9. The process according to claim 3, wherein the second catalyst is communicated from the second reaction vessel to the reaction vessel.

10. The process according to claim 1, wherein the fresh catalyst is provided to the riser.

11. The process according to claim 1, wherein the medium or smaller pore zeolite comprises ZSM-5 catalyst and wherein the ZSM-5catalyst is withdrawn at a rate to replace the catalyst inventory over a period of up to about 35 days.

* * * * *